US005913507A

United States Patent [19]

Lauricella, Jr.

[11] Patent Number: 5,913,507

[45] Date of Patent: Jun. 22, 1999

[54] PORTABLE WINCH

[76] Inventor: Salvatore Lauricella, Jr., 33 Broezel St., Lancaster, N.Y. 14086

[21] Appl. No.: 08/871,865

[22] Filed: Jun. 9, 1997

[51] Int. Cl.[6] ..... B66D 1/36

[52] U.S. Cl. ..... 254/325; 254/327

[58] Field of Search ..... 254/323, 325, 254/326, 342, 327

[56] References Cited

U.S. PATENT DOCUMENTS

| | | | |
|---|---|---|---|
| 2,808,160 | 10/1957 | La Londe | 214/86 |
| 3,159,368 | 12/1964 | Ahlbin et al. | 248/225 |
| 3,716,217 | 2/1973 | Watabe | 254/139.1 |
| 3,718,317 | 2/1973 | Hilmer | 254/186 HC |
| 3,767,230 | 10/1973 | DeVries | 280/477 |
| 3,794,355 | 2/1974 | Cracolice | 280/482 |
| 3,945,517 | 3/1976 | Carley | 214/85.5 |
| 4,021,074 | 5/1977 | Heiser | 298/22 R |
| 4,664,331 | 5/1987 | Halbrook | 242/86.5 R |
| 4,679,813 | 7/1987 | Byrnes | 280/406 A |
| 4,826,197 | 5/1989 | Heinzen | 280/414.1 |
| 5,048,854 | 9/1991 | Clark | 280/477 |
| 5,072,962 | 12/1991 | Webb | 280/414.1 |
| 5,085,408 | 2/1992 | Norton et al. | 254/325 |
| 5,507,515 | 4/1996 | Schellenberg et al. | 280/491.5 |
| 5,593,139 | 1/1997 | Julian | 254/325 |

*Primary Examiner*—Donald P. Walsh
*Assistant Examiner*—Minh-Chau Pham
*Attorney, Agent, or Firm*—Crossetta & Associates

[57] ABSTRACT

This invention relates to an improved portable winch apparatus, which can be removably mounted to standard vehicular hitching arrangements to enable convenient winching in a plurality of pulling angles and planar orientations.

20 Claims, 4 Drawing Sheets

PORTABLE WINCH

This invention relates generally to portable winch apparatus and more specifically to an improved portable winch device which can be removably mounted to standard vehicular hitching arrangements to enable convenient winching in a plurality of pulling angles and planar orientations.

BACKGROUND OF THE INVENTION

With the proliferation of off-road vehicles for recreational and/or work related activities, vehicle operators often find themselves in situations requiring a suitable means for extricating their vehicle and/or vehicles of others and/or equipment or the like from problematic situations wherein a winch is necessary or desired. Fixed mounted winching devices are commonly available for vehicles, however such devices are generally limited in their angular pulling direction and are generally mounted to either the front or the rear of the vehicle as to be dependent upon the ability to conveniently change the orientation of the vehicle for efficient use.

Portable winching devices for vehicular use have been disclosed in the prior art, but generally are heavy, cumbersome devices which are difficult to mount and require the vehicle to have special hitching apparatus for mounting. U.S. Pat. No. 5,072,962 discloses a portable winching device which essentially comprises a winch rigidly mounted with the winding drum facing along the length of the an elongate drawbar, which in turn has box hitch connectors arranged on opposite ends. The drawbar is removably mounted at one end to a vehicle by means of a rigid box hitch and at the other end comprises a means to mount a hitch ball for mounting the tongue of a trailer thereto. Such device has a portable utility in that it can be used in conjunction with multiple different trailers, but it too is limited to rigidly extending generally perpendicular to the vehicle on which it is mounted, thus it too is limited in pulling direction and dependent upon the orientation of the vehicle, generally limiting its utility to pulling equipment such as a boat or the like onto a trailer whose tongue it is mounted to.

U.S. Pat. No. 5,593,139 discloses another arrangement wherein a winch is mounted to a drawbar, having an end of the drawbar comprising a male member for rigidly engaging a box hitch of a vehicle. This arrangement is similarly limited however, to rigidly extending generally perpendicular from the vehicle and generally comprises the same limitations as aforenoted.

It is a primary object of the present invention to provide an improved portable winch which is convenient to carry and easily mountable to common vehicular hitching apparatus.

It is a further object of the invention to provide an improved portable winch, which removably connects to common ball hitch vehicle trailering apparatus.

It is another object of the invention to provide an improved portable winch which has a winding barrel operable through a wide horizontal arc and wide vertical planar orientation of pulling directions, is safe and convenient for use by an inexperienced operator.

These and other objects of the invention will become apparent in the following recitation of the invention.

SUMMARY OF THE INVENTION

The present invention comprises an improved portable winch apparatus, which conveniently mounts to common vehicular ball hitch arrangements and is enabled to safely pivot thereat to enable the winding barrel to face an object to be pulled through a wide directional arc in varying planes of orientation. The apparatus of the invention comprises a winch, rigidly mounted to an elongate drawbar with the winding barrel facing along the drawbar to enable play-out of a pull line or the like therefrom generally along the length of the drawbar toward the object to be pulled.

A first end of the drawbar comprises a receptacle for removably capturing a common vehicular pivot type hitch such as hitch ball or pintle hook and lunette ring, and a second end of the drawbar comprises means for vertically supporting the drawbar and/or means for guiding play-out of the pull line along the drawbar length.

In a preferred embodiment of the invention, the drawbar is an elongate structural member of about 2 to about 5 feet in length and comprises a locking hitch ball receiver on a first end. The structural member generally constitutes a support beam, strut or the like, preferably of boxed, "U" or rounded construction. The primary forces imposed on the member during general use are tensile forces along its length, thus structural enhancement of the drawbar to prevent bending across its length is not generally necessary.

The ball receiver can be of any convenient construction, and generally comprises a rounded socket type receptacle sized to receive a top portion of a ball type hitch and containing locking means which generally engage the underside of the ball to enable the ball to pivot through an arc and through differential orientations while maintaining the ball locked securely within the socket. Ball receivers of such type are commonly available and have been popularly used in trailer embodiments for many years.

A pintle lock and lunette ring, hitch arrangement can also be utilized in the invention, for example, wherein a circular lunette ring receiver takes the place of the ball receiver, and is sized to capture a pintle lock, pin or the like. In heavy equipment, the pin is generally a lunette ring like receiver, whereas in lighter equipment it generally comprises a pin or the like removably arranged between legs of a "U" shaped frame member or the like.

The winch itself is rigidly mounted to the elongate drawbar generally toward the middle of its length, with the barrel wind being positioned to play-out pulling line in a direction along the drawbar toward the end opposite the ball receiver end. The winch may be electrically or otherwise automatically operated but generally a hand operated winch is preferred. In a further preferred embodiment a carrying handle is mounted to the winch or along the drawbar proximate the winch to enable convenient carrying of the device and/or supported operation of the winch. In a particularly preferred embodiment the handle is arranged to straddle the top of the winch, and provide a convenient support for a person operating the winch.

The end opposite the first end comprises a means for guiding the play-out and retrieval of cable, rope, line or the like from and to the winding barrel of the winch. The guide member can comprise a tubular member, a hole in a rigid plate, or one or more rollers arranged along the drawbar. In one arrangement the guide means comprises rollers in opposing relationship, preferably in a triangular, rectangular or the like arrangement around an opening, for cable to pass through. In another arrangement rollers are mounted generally horizontally in a ladder array to generally parallel supports extending from about the opposite end of the drawbar. In a particularly preferred arrangement a roller is fashioned in a "V" shape, such as for example conically extending in opposite directions from about a center vertex. In a preferred embodiment the guide member comprises a handle to enable two-handed carrying and/or operation of the device.

The device of the invention further comprises a vertical support member arranged proximate the opposite end of the drawbar to enable free standing support of the device when mounted at its first end to a hitch. In a preferred arrangement the vertical support member is hingedly mounted to enable convenient folding of the support to a convenient storage position when not in use. In a further preferred embodiment, the vertical support member is of adjustable length to enable convenient adjustable variation in planar orientation of the device under variable use conditions. In still another embodiment the vertical support member comprises shock absorbing means.

In another embodiment of the device of the invention, a light source is mounted to the drawbar for convenience of operation during low natural light usage. In a particularly preferred embodiment the draw bar comprises a bumper arrangement at the opposite end so that the object can be winched to engage the opposite end for towing or the like.

The arrangement of the device of the present invention enables safe and convenient directional winching operation through a wide arc and planar orientation. The pivot mounting of the drawbar, particularly to a ball hitch, enables alignment of the drawbar generally through a greater than 180° lateral arc depending upon the amount the ball hitch extends from the vehicle. Similarly, the planar orientation is pivotable through an arc, generally however less than about 120°. An advantage of the device of the present invention is the ability to automatically maintain the winding barrel facing the object being pulled, thus maintaining the pulling cable or the like in about a straight line from the face of the barrel without engaging line guides or the like. Thus, the device automatically pivots laterally toward the object to be winched and automatically pivots with changes in relative planar orientation of the object in respect to the winch.

For a fuller understanding of the device of the present invention, reference should be made to the following detailed description taken in connection with the accompanying drawings.

DETAILED DESCRIPTION OF THE INVENTION

Figure 1:
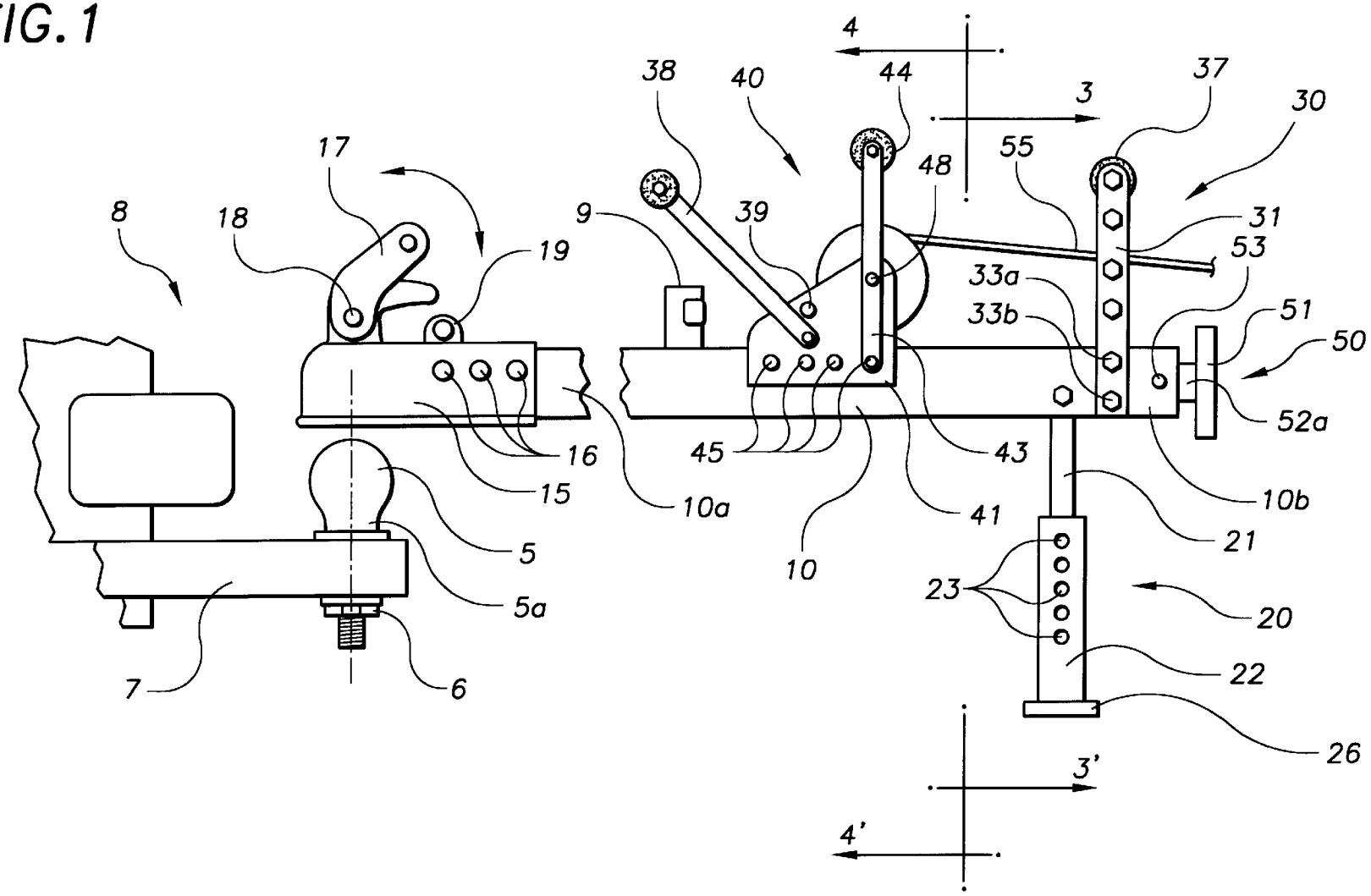
FIG. 1 is a side view of a portable winch device of the invention.
Figure 2:
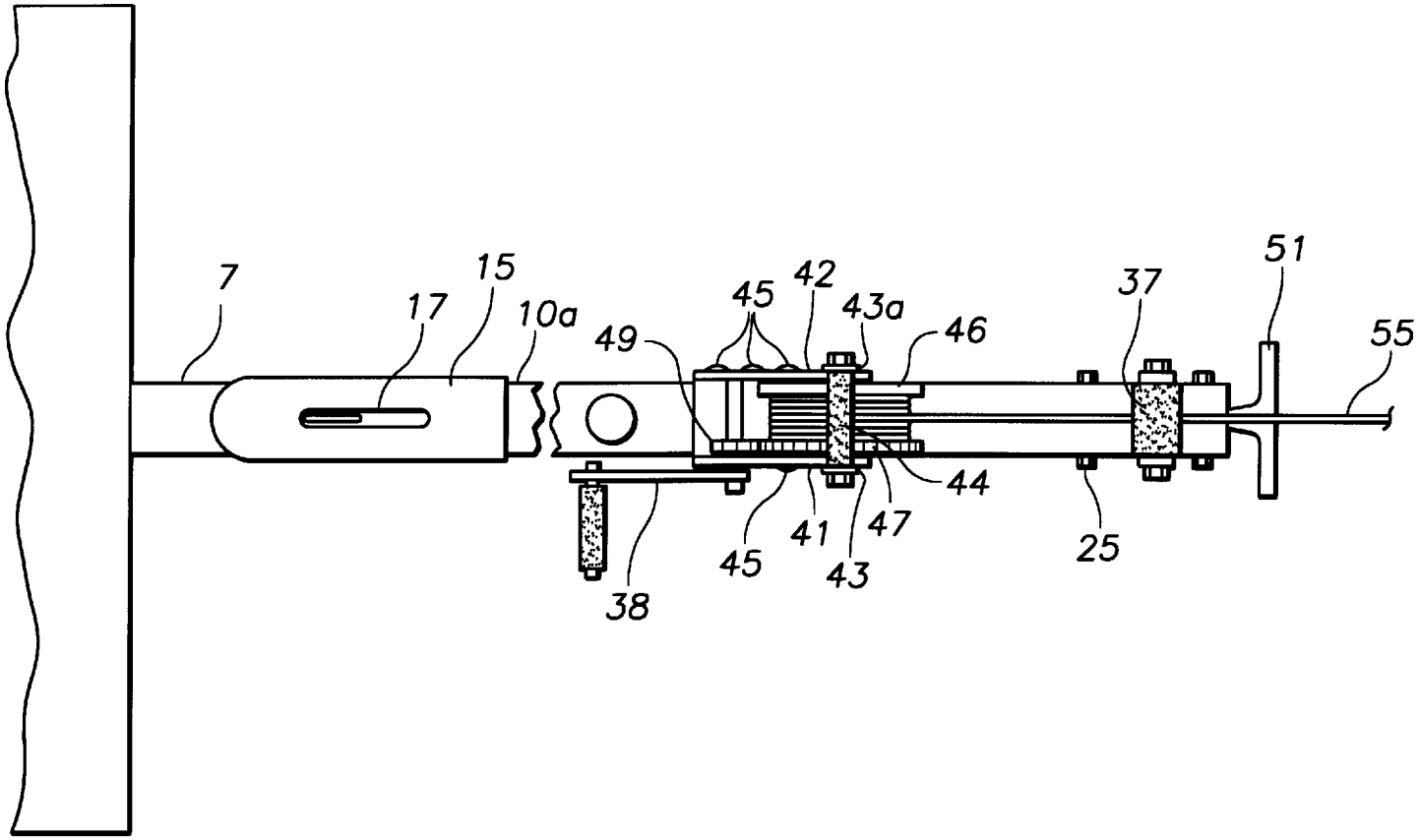
FIG. 2 is a top view of the portable winch device of FIG. 1.
Figure 3:
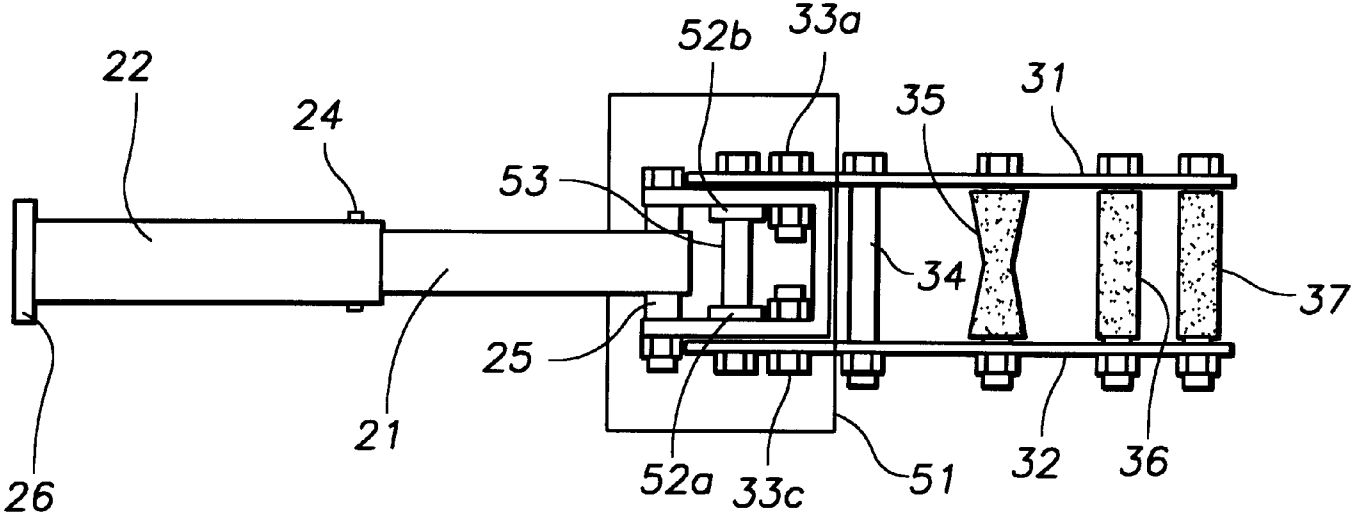
FIG. 3 is a sectional view of the portable winch device of FIG. 1, taken along about line 3-3' of FIG 1.

Referring now to FIGS. 1–4, therein is illustrated a portable winch device of the invention, juxtaposed with a standard ball hitch at the front or rear of a vehicle. Hitch ball 5 is illustrated as being bolt mounted 6 to hitch support frame 7, the hitch support frame illustrated as extending generally perpendicular outwardly from the front or rear of vehicle 8 and being mounted to the vehicle.

The device of the invention is illustrated as comprising elongate drawbar 10, which has hitch ball receiver 15 mounted on a first end 10*a*, vertical support 20 and cable guide 30 mounted at about a second opposite end 10*b* and winch 40 mounted along the drawbar.

Hitch ball receiver 15 is illustrated as mounted to "U" shaped drawbar 10 by means of rivets 16 and comprising handle 17, which when pivoted around stud 18 into a vertical position allows entry of hitch ball 5 into the receiver, and when pivoted to a generally horizontal position enables a yoke arrangement 14 to engage about the neck 5*a* of hitch ball 5 securing the underside of the ball into the receiver. Handle 17 comprises a hole which aligns with a hole in lock 19 when pivoted to the horizontal, enabling locking the handle in a ball securing position through a bolt, padlock or the like.

Drawbar 10 is illustrated as generally comprising a winch 40 mounted along the drawbar, light 9 mounted adjacent the winch, guide assembly 30, vertical support assembly 20 and bumper 50.

Winch 40 is illustrated as comprising side plates 41 and 42 which straddle opposite legs of "U" shaped drawbar 10, and vertical straps 43,43*a* which straddle the side plates and support handle 44, the plates and straps being mounted to the legs of the drawbar by means of rivets 45. The winding barrel comprises circular geared plate 47 and restraining plate 46, mounted along an elongate hollow cylinder (not shown). Shaft 48 is mounted to side plate 41, and extends through the hollow cylinder mounting to side plate 42, enabling the winding barrel to rotate therearound. Gear 49 is rotatably mounted by shaft 39 to side plate 41 and is arranged to engage a mating gear along the periphery of geared plate 47. Handle 38 is mounted to rotate gear 49 and enable the rotation of the winding barrel in conjunction with rotation of the handle. It should be understood that though direct engagement among gear 49 and gear plate 47 is illustrated, indirect gear arrangements are also contemplated as within the invention.

Pulling line 55 is wound around the elongate cylinder of the winding barrel and feeds through guide assembly 30 for attachment to the object to be pulled, such that rotating the winding barrel in a first direction winds the cable on the barrel and in an opposite direct plays out the cable.

Guide assembly 30 is illustrated as comprising vertical support bars 31 and 32, which are mounted to "U" shaped drawbar 10 by bolts (33*d* not shown). In the illustrated embodiment, the guide assembly comprises lower roller 34, middle roller 35, upper roller 36 and handle 37. Middle roller 35 is depicted as fashioned in a "V" shape, conically extending in opposite directions from about a center vertex. Bottom roller 34 and top roller 36 are depicted as being cylindrical, and handle 37 is depicted as cylindrical and comprised of a soft polymeric material or the like. The rollers function to both maintain separation of the vertical support bars and maintain a convenient surface on which the line can ride when winding and unwinding from the winch. The rollers are depicted as revolving around a central axis, which in the illustration comprises a bolt means, but it also contemplated as within the invention to be non-revolving.

Vertical support 20, is illustrated as comprising an adjustable telescoping arrangement which is pivotally mounted to fold into drawbar 10 for storage. Thus, vertical support 20 comprises an upper elongate cylindrical member 21 which is sized to matingly telescope into lower elongate cylindrical member 22 having base 26. Lower member 22 comprises a plurality of longitudinally spaced holes 23 along its length, with aligned mating holes (not shown) arranged at the opposite side of diameters through the lower member. Upper member 21 comprises a pair of holes (not shown) at opposite ends of a diameter, which are arranged to align with various sets of holes in the lower member. Removable pin 24 is sized to insert through the aligned holes of the upper member and lower member through the plurality of spaced positions and thus fix the vertical support at various telescoped lengths.

Upper member 21 is pivotally mounted to bolt 25 and enables pivoting vertical support 20 through various angles with drawbar 10. In the preferred embodiment illustrated, base 26 of lower member 22 is sized to insert between the legs of "U" shaped drawbar 10, and thus pivot the vertical support to a storage position between the legs of the drawbar.

Bumper 50 is illustrated as being pivotally mounted to end 10*b* of drawbar 10. Therein, bumper plate 51 comprises tabs 52*a* and 52*b* which are pivotally mounted through bolt 53 in an arrangement enabling pivoting of the plate to engage an object which has been winched to tightness thereagainst. It should be understood that though bumper 50 is illustrated as being pivotally mounted, it may be rigidly mounted or may even be removably mounted at end 10*b* of the drawbar.

In a further embodiment, a light is mounted at end 10*b* of the drawbar to enable illuminating the object to be pulled, such as for example in place of the bumper, and in a still further embodiment the light is removably mounted.

Figure 5:
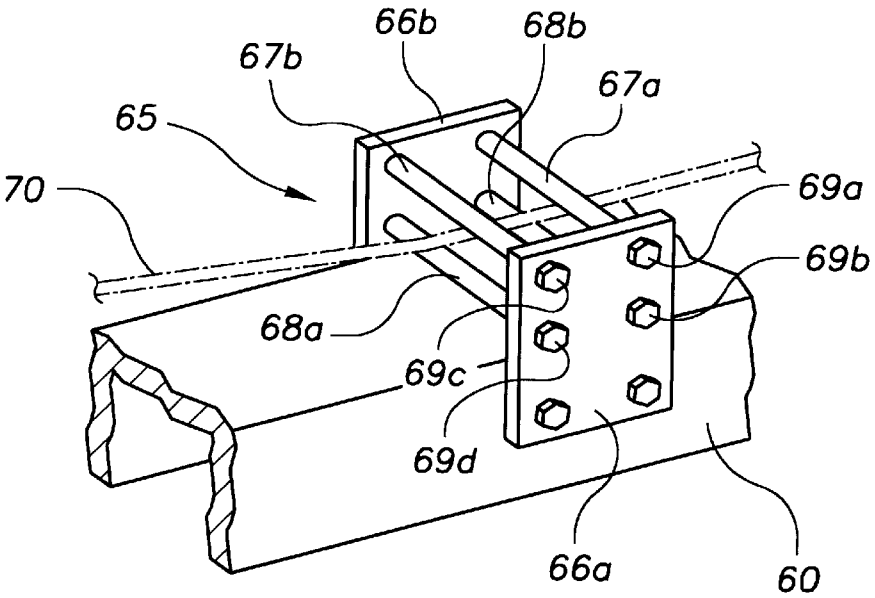
FIG. 5 is a partial sectional view of a further guide member of the invention.
Figure 4:
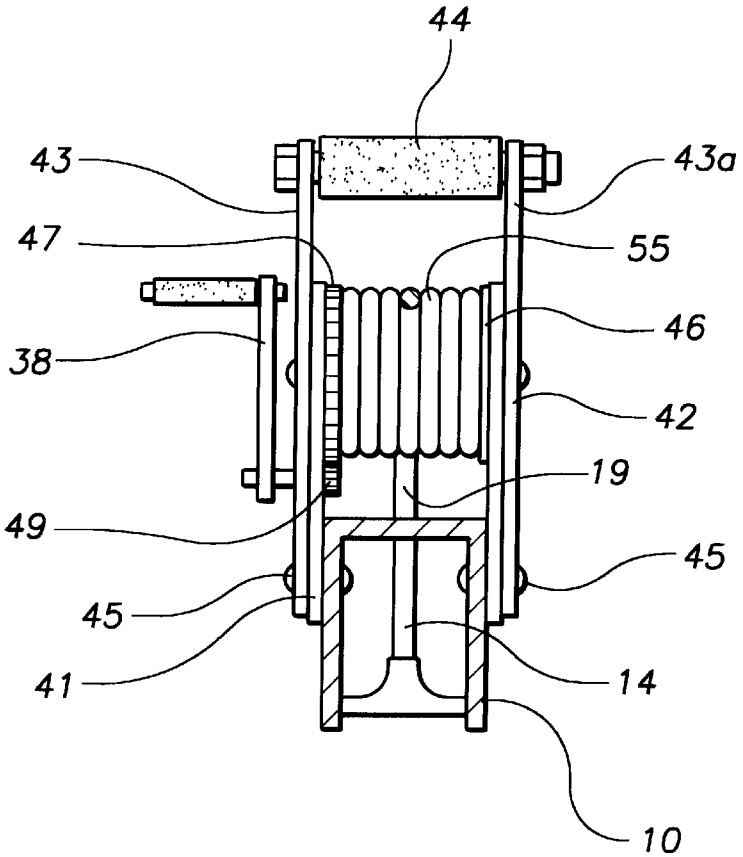
FIG. 4 is a sectional view of the portable winch device of FIG. 1, taken along about line 4-4' of FIG 1.

FIG. 5 illustrates another embodiment of a guide assembly of the invention. Therein, drawbar 60 is illustrated as comprising horizontally elongate guide assembly 65, comprising plates 66*a* and 66*b*, upper rollers 67*a* and 67*b* and lower rollers 68*a* and 68*b*, which are mounted to plates 66*a* and 66*b* by bolts 69*a–d*. In the illustrated embodiment, the rollers are depicted as cylindrical to guide cable 70, but it should be understood they may be configured in a "V" shape, conically extending in opposite directions from about a center vertex. Similarly, it should be understood that a handle is contemplated as being included, mounted to the guide through vertical supports from mounted to plates 66*a* and 66*b*.

I claim:

1. An improved portable winch apparatus comprising:

an elongate drawbar, having a first end comprising a receiver enabled for lockingly mounting to a vehicles pivot hitch, and a second opposite end;

a winch, rigidly mounted along said drawbar, having a winding barrel facing toward said second opposite end of said drawbar and comprising a winching line;

an elongate vertical support assembly, having an upper member in telescopic arrangement with a lower member, said upper member of said support assembly being pivotally mounted to said drawbar and arranged to coact with said lower member for adjustable lengthening and shortening of said support assembly;

a line guide, mounted along said drawbar spaced from said winding barrel toward said second opposite end and arranged along about said drawbar to guide winching line extending from said winding barrel in a direction toward said opposite end;

wherein said receiver is arranged to lockingly capture a pivot to enable pivoting said drawbar through an arc in response to winching line force against said line guide, and maintain said winding barrel of said winch about perpendicular to the direction of pull of said winching line.

2. The apparatus of claim 1 wherein said receiver comprises a ball receiver enabled for lockingly mounting to a hitch ball to enable pivoting said drawbar.

3. The apparatus of claim 1 wherein said receiver comprises a lunette ring sized to engage a pintle lock hitch to enable pivoting said drawbar.

4. The apparatus of claim 1 wherein said winch is electric powered.

5. The apparatus of claim 1 wherein said vertical support assembly, comprises a tube telescoping into another tube, enabled for adjustably varying the planar orientation of the opposite end of the drawbar in respect to said first end.

6. The apparatus of claim 1 wherein said vertical support assembly comprises shock absorbing means.

7. The apparatus of claim 1 wherein said winch, comprises a handle arranged for carrying said apparatus.

8. The apparatus of claim 1 wherein said drawbar is of U shaped configuration.

9. The apparatus of claim 1 wherein said line guide comprises rollers arranged in opposing relationship around an opening sized to enable passage of winch line.

10. The apparatus of claim 9 wherein said rollers encircle said winch line.

11. The apparatus of claim 9 wherein said rollers are generally horizontally mounted in a ladder array to generally parallel supports extending generally vertically upward from said drawbar.

12. The apparatus of claim 9 wherein a roller conically extends in opposite directions from about a center vertex.

13. The apparatus of claim 9 wherein said line guide comprises a handle.

14. The apparatus of claim 9 wherein said line guide comprises rollers mounted along said drawbar.

15. The apparatus of claim 1 comprising bumper means at said second opposite end of said drawbar.

16. The apparatus of claim 15 wherein said bumper means is pivotally mounted to said drawbar.

17. The apparatus of claim 1 comprising illuminating means.

18. An improved portable winch apparatus comprising:

an elongate drawbar, having a first end comprising a ball receiver enabled for lockingly mounting to a hitch ball, and a second opposite end;

a winch, rigidly mounted along said drawbar, having a winding barrel facing toward said second opposite end of said drawbar and comprising a winching line;

an elongate vertical support assembly, having an upper tube member in adjustable telescopic arrangement with a lower tube member, said upper member of said support assembly being pivotally mounted to said drawbar said vertical support assembly being enabled for adjustably varying the planar orientation of the drawbar;

a line guide, mounted along said drawbar spaced from said winding barrel and arranged along about said drawbar and enabled to guide winching line extending from said winding barrel in a direction toward said second opposite end;

wherein said ball receiver lockingly captures said hitch ball to enable pivoting said drawbar through an arc in response to winching line force against said line guide, to maintain said winding barrel of said winch about perpendicular to the direction of pull of said winching line.

19. An improved portable winch apparatus comprising:

an elongate drawbar, having a first end comprising a receiver enabled for lockingly mounting to a vehicles pivot hitch, and a second opposite end;

a winch, rigidly mounted along said drawbar, having a winding barrel facing toward said second opposite end of said drawbar and comprising a winching line;

an elongate vertical support means, arranged at about said opposite end of said drawbar;

a line guide, mounted along said drawbar spaced from said winding barrel and arranged along said drawbar to surround and guide winching line extending from said winding barrel in a direction toward said winding barrel;

wherein said receiver lockingly captures a pivot to enable pivoting said drawbar through an arc in response to winching line force against said line guide, to maintain said winding barrel of said winch about perpendicular to the direction of pull of said winching line and support said second opposite end of said drawbar in the direction of said winching line.

20. The apparatus of claim 19 wherein said vertical support means is pivotally mounted to said drawbar.

* * * * *